United States Patent [19]

Mulzet

[11] 4,386,730

[45] Jun. 7, 1983

[54] CENTRIFUGE ASSEMBLY

[75] Inventor: Alfred P. Mulzet, Endicott, N.Y.

[73] Assignee: International Business Machines Corporation, Endicott, N.Y.

[21] Appl. No.: 283,856

[22] Filed: Jul. 16, 1981

Related U.S. Application Data

[63] Continuation of Ser. No. 926,676, Jul. 21, 1978, abandoned.

[51] Int. Cl.[3] ..... B04B 11/00

[52] U.S. Cl. ..... 494/81; 422/101; 494/43; 494/45; 494/66

[58] Field of Search ..... 233/27, 26, 28, 47 A, 233/47 R, 46, 16, 19 R, 19 A, 1 R, 1 D

[56] References Cited

U.S. PATENT DOCUMENTS

| | | | |
|---|---|---|---|
| 3,858,796 | 1/1975 | Unger | 233/27 |
| 4,010,894 | 3/1977 | Kellogg | 233/27 |
| 4,094,461 | 6/1978 | Kellogg | 233/471 R |

FOREIGN PATENT DOCUMENTS

| | | | |
|---|---|---|---|
| 729169 | 5/1955 | United Kingdom | 233/27 |
| 812115 | 4/1959 | United Kingdom | 233/27 |
| 873494 | 7/1961 | United Kingdom | 233/27 |

*Primary Examiner*—Robert W. Jenkins

*Attorney, Agent, or Firm*—Sughrue, Mion, Zinn, Macpeak and Seas

[57] ABSTRACT

A centrifuge assembly useful for two stage blood platelet separation by counterflow comprising a channeled rotor assembly and a fluid container disposed in the channel, whereby the centrifugal separation effects in the fluid container are determined by the geometry of the channel in thr rotor. The fluid container is preferably formed from semirigid plastic material and is considered a disposable item, discarded after a single use. The rotor assembly preferably includes a removable filler piece or center piece formed from a single piece of material and having therein an open-topped channel having dimensions appropriate to receive the semirigid container, which is suitably curved and placed in the channel. Fluid connections are provided from a multichambered cavity attached to the ends of the container to an axially located multichannel rotating seal. The channel is divided into two distinct circular portions, the first portion of the channel being spiral-like and the second portion having a plurality of radiuses, each measured from a different center. The spiral increases radially outward from its juncture of the first stage and the second stage. A transition section connects the two portions, and forms a spillway between the two portions.

10 Claims, 7 Drawing Figures

CENTRIFUGE ASSEMBLY

This is a continuation, of application Ser. No. 926,676 filed July 21, 1978, now abandoned.

A publication of the U.S. Department of Commerce, National Technical Information Service, No. PB-277 dated July 19, 1977, and titled "Blood Cell Separator" shows and describes an arrangement using a helical blood bag, but does not disclose the detailed geometry of the present invention.

A selection of papers dealing with blood centrifuging is entitled "Leucocytes: Separation Collection and Transfusion" Edited by J. M. Goldman and R. M. Lowenthal, and published in 1975 by Academic Press.

BACKGROUND OF THE INVENTION (1) Field of the Invention

Previous centrifuges for separating the components of blood are known in which the centrifuge bowl is reusable, and is provided with relatively complex channeling or grooves, and fluid connections, making the device expensive and difficult to clean and sterilize for each use.

(2) Description of the Prior Art

The present invention provides an improved centrifuge bowl and container assembly for use with blood cell separators of the type shown, for example, in U.S. Pat. No. 3,489,145. In this prior arrangement a solid centrifuge element was used, having appropriate channels cast or machined therein, and did not contemplate reusable bags. Bag structures not requiring channeled support elements are disclosed in U.S. Pat. Nos. 3,748,101 and 4,007,871. However, such arrangements are not as efficient or economically manufactured as the subject invention. None of this art or other known prior art provides a centrifuge assembly comprising a solid reusable rigid center element arranged to provide a conformed channel for a disposable tube of semirigid material, having fluid connections to appropriate ends thereof. U.S. Pat. No. 4,010,894 also discloses a centrifuge container which can be used for two-stage platelet separation, but it has been found that the present invention provides a much higher yield.

A co-pending application, Ser. No. 839,156, (IBM Docket No. EN977007) discloses and claims a centrifuge assembly including a container having a circular portion and a spiral portion, but which does not correspond to the detailed geometry of the present invention as described and claimed herein.

SUMMARY OF THE INVENTION

It is a general object of this invention to provide an improved rotor assembly for a centrifuge.

Another object of the invention is to provide an improved rotor assembly utilizing a disposable container for centrifuging blood to obtain different fractions therefrom.

A further object of the invention is to provide an improved rotor assembly and associated container for centrifuging blood, which is simple and economical in construction, and the container is disposable after a single use.

Still another object of the invention is to provide an improved blood centrifuge assembly particularly suited for efficient two-stage platelet separation.

The foregoing and other objects, features and advantages of the invention will be apparent from the following more particular description of preferred embodiments of the invention, as illustrated in the accompanying drawings and described in connection therewith in the annexed specification.

Briefly described, the improved assembly provided by this invention comprises a rotor assembly, which comprises, in a first embodiment, a centrifuge bowl and a filler or center piece, which can be removable from the bowl.

An open-topped channel, substantially rectangular in cross section, is machined, molded or otherwise formed in the filler piece. The channel has a first portion which is circular, having a radius which extends from a point which is slightly offset from the true center. This first portion extends through a first angular distance, of the order of 150 degrees, for example, from the innermost end of the channel. A short transition portion connects the terminal end of the first portion with the initial end of the second or spiral-like portion of the channel, which initial end is located at a shorter radius than the radius of the first portion.

The transition portion has a second arcuate dimension of approximately 24 degrees, for example, and is directed radially inward, and rapidly narrowing to the dimension of the second spiral portion.

The second spiral-like portion comprises a plurality of arcuate segments, of increasing radius, and having centers displaced from the true center. The spiral portion progresses radially outward, and terminates near the angular location of the initial end of the circular portion.

Fitted into the channel described above is a fluid container comprising a tube having a rectangular or substantially rectangular cross section, closed at both ends by a cavity member providing inlet and outlet chambers and provided with a plurality of fluid connections or inlet and outlet tubes. These tubes, together with a suitable rotating seal, permit the introduction of whole blood into the container and the withdrawal of blood fractions following centrifugal separation. The cross-sectional area of the second portion of the container is substantially one-fourth of the cross-sectional area of the first portion of the container, in order to achieve higher flow velocity in the spiral portion. The fluid container and the tubing connections may be formed of medical grade polyvinyl chloride.

The cross section of the second portion is designed to have a greater vertical height than the vertical height of the first portion, and conversely, the width of the second portion is less than the width of the first portion.

In another embodiment, the entire rotor assembly is made in one piece by molding and/or machining, with a channel as above described formed in the rotor.

BRIEF DESCRIPTION OF THE DRAWINGS

In the drawings.

Similar reference characters refer to similar parts in each of the several views.

DETAILED DESCRIPTION OF THE PREFERRED EMBODIMENTS

Figure 1:
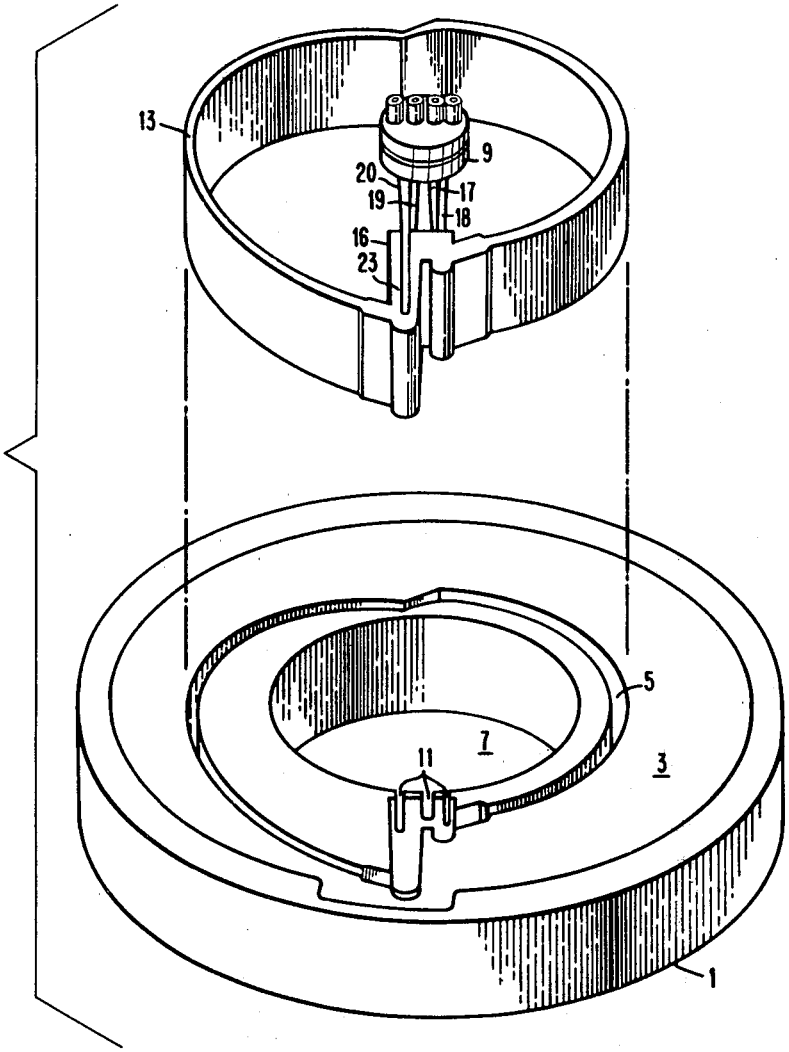
FIG. 1 is a diagrammatic perspective view showing a centrifuge bowl, a filler or center piece, and a fluid container in an exploded relation in accordance with one preferred form of the invention.

Referring to the drawings, there is shown, in FIG. 1, a centrifuge bowl 1, arranged to be spun around an axis of rotation by suitable means, not shown since the specific rotating means is not germane to this invention. The bowl can be formed of any suitable material such as metal or plastic or a combination of materials.

Seated within the bowl 1 is a filler or center piece 3 which can be formed of any suitable material, by molding and/or machining. The filler piece 3 is dimensioned so that when in place in the bowl 1, the filler will be concentric with the bowl. It can be retained in place on a central hub, or on the outer rim or a plurality of distributed bosses or pins. A channel 5, described later in detail, is machined, molded or otherwise formed in the top surface of filler piece 3. The filler piece 3 has a central hole or opening 7 which accommodates the fluid connections to the fluid container, to be subsequently described, and a rotating seal 9. Also the opening may be dimensioned to fit over a central hub in the bowl, to accurately locate and retain the filler piece. The seal 9 may be of the type shown in U.S. Pat. No. 3,489,145, for example. Filler piece 3 also has a plurality of radial slots 11 in the upper portion of the piece, which receive the fluid connections or tubes to the container.

The fluid container comprises a length of semi-rigid plastic tubing 13, preferably of medical grade polyvinyl chloride and having a substantially rectangular cross section. Different cross-sectional areas are provided, as later described. The tubing is formed in a spiral-like configuration as shown, with each end sealed in a cavity 16. The container is generally shaped to fit the channel 5. Fluid connections to the container are provided by a plurality of tubing connections 17, 18, 19 and 20, to the cavity 16, one of which (17) serves as an input connection. The cavity 16 is provided with two separate chambers, one of which serves a dual function as the input chamber and red blood cell chamber and the other of which serves as the collection chamber for the platelet concentrate and the plasma. Connection 18 is for extraction of the red cells, connection 19 serves as an output connection for plasma, and connection 20 serves as a platelet concentrate outlet. When the container 13 is placed in channel 5, the tubes 17 through 20 are placed in the appropriate slots 11 in filler piece 3.

Figure 2:
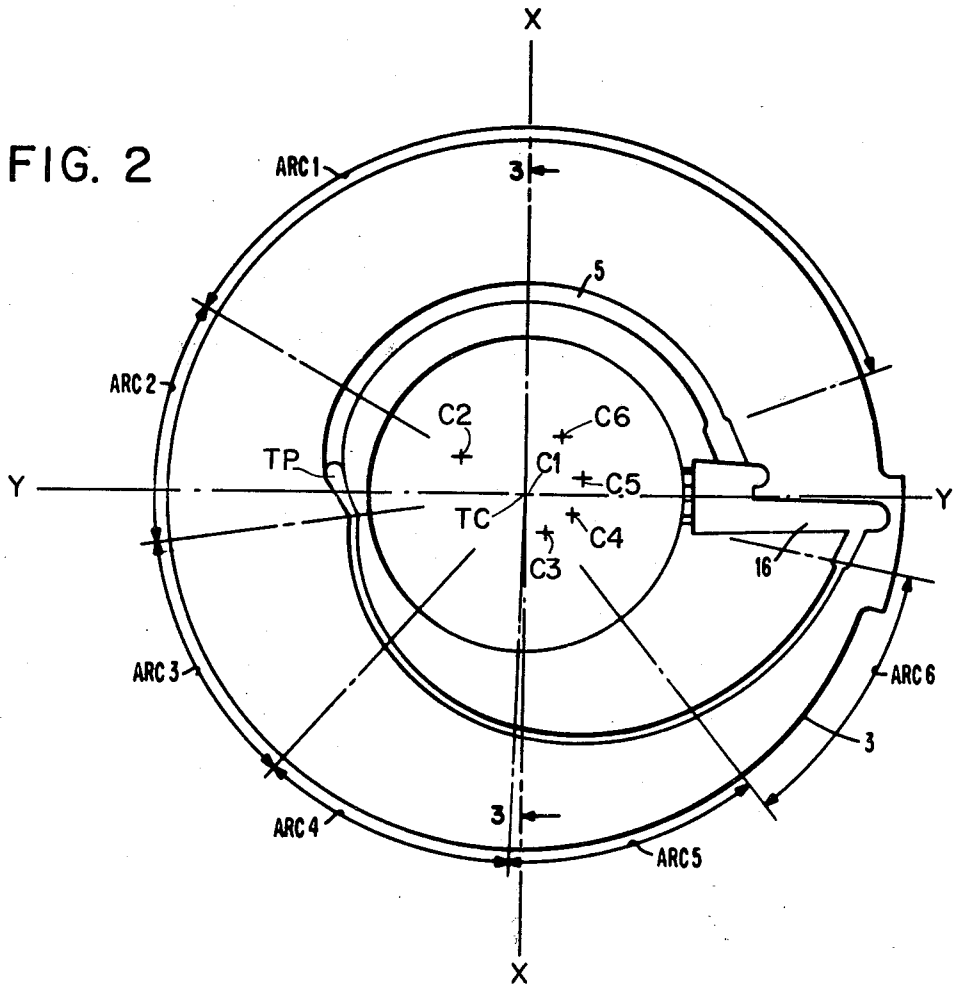
FIG. 2 is a diagrammatic plan view of the filler piece shown in FIG. 1.

FIG. 2 is a plan view of the filler piece shown in FIG. 1, and further shows the relationship between the various elements, particularly the geometric relationships for the various portions of the channel, and hence for the container.

It should first be noted that the channel, and hence the container, have two basic geometric patterns. The innermost or first portion, extending for substantially 130 degrees, is circular-like for the first part thereof (ARC1) and is spiral-like inward for approximately the last 38 degrees of arc (ARC2). The outermost or second portion comprises four arcuate segments (ARC3, ARC4, ARC5, ARC6), each having a different radius of different decreasing magnitudes respectively, and extending from different centers C3, C4, C5 and C6, which are located at variously displaced distances from the true center TC. These segments extend through arcs ARC3, ARC4, ARC5 and ARC6, respectively, and total to substantially 180 degrees. The spiral is defined by the equation:

$$r = 138.9e^{-0.23\theta},$$

in millimeters, and is approximated by four circular arcs having four different radii and turned from four different centers. The radii, center location and angular extremes of the four arcs are defined in the following table:

| SEGMENT | CENTER | RADIUS | CENTER LOCATION FROM X—X | CENTER LOCATION FROM Y—Y | ANGULAR EXTREMES FROM ARC CENTER | |
|---|---|---|---|---|---|---|
| ARC1 | C1 | 83.1 | 1.0 | 0 | 20°14′ | 150°21′ |
| ARC2 | C2 | 51.9 | 26.1 | 15.4 | 150°21′ | 209°22′ |
| ARC3 | C3 | 77.4 | 8.2 | 15.7 | 175°35′ | 215°35′ |
| ARC4 | C4 | 91.0 | 19.3 | 7.8 | 215°35′ | 255°35′ |
| ARC5 | C5 | 106.9 | 23.2 | 7.6 | 255°35′ | 295°35′ |
| ARC6 | C6 | 125.5 | 15.2 | 24.4 | 295°35′ | 335°35′ |

The linear measurements are in millimeters.

These segments taken together form a spiral-like portion for platelet concentrate collection as subsequently described. A short transition portion TP couples the first and second portions together. As shown, the transition section leads radially inward from the outlet end of the first portion to the inlet end of the second portion. The inlet connection 17 for the whole blood is connected to the inlet chamber of the cavity joining the ends of the tubing. Also, the fluid connection 18 to the inlet chamber is provided for removing the red blood cells which are centrifuged against the outer wall of the first portion. The end of connection 18 extends outwardly almost to the outer wall of the inlet chamber, so that the packed red cells can be removed without removing any of the incoming whole blood.

The geometry of the first portion is such that the red blood cells which move to the outer wall flow against the direction of flow of the incoming whole blood, and reach the bottom of the inlet chamber, from whence they are removed by the connection 18. The input line 17 is terminated at the top or inward end of the inlet chamber, so that the whole blood and the packed red cells are adequately separated.

Separation of platelets occurs in both the first (inner) and second (outer) portions. Some of the platelets which separate in the inner or first portion settle on the interface between the red cell and plasma at the downstream dam of the channel in the transition portion TP. These platelets tend to be the largest and therefore, most desirable platelets to collect. Consequently, the first portion of the assembly is designed such that these separated platelets can easily be spilled over into the second portion without spilling many red cells.

The essential design features of the first portion of the assembly are as follows:

1. The inner wall of the first portion is smooth, continuous and gently changing so that the interface can be drawn to the innermost radial point of the channel without any substantial turbulence in the flow which would cause an excessive mixing of the red cell-platelet-plasma interface.

2. The majority of the first portion channel is slightly offset from the true center to assist in pumping the separated red cells back to the RBC port.

3. At the downstream extreme, the first spiral portion of the channel deflects inwardly. This provides a comfortable operating point for the interface at which the plasma layer in the majority of the channel is very thin and the risk of accidentally spilling red cells to the second channel is minimal. Keeping the plasma layer thin is essential to high yields because the thin layer yields a high plasma velocity which assists in keeping the platelets moving toward the second stage.

4. The first portion of the channel narrows just prior to the entrance to the second portion. This narrowing is used to concentrate the platelets which are intentionally spilled to the second portion after collecting on the interface of the first portion. The narrowing makes it easier to detect when the majority of the platelet concentrate has been spilled.

Using conventional stroboscopic techniques, the operator of the centrifuge can observe the interface at the transition portion TP, and adjust the flow rates so that the interface approaches very closely the inner wall of the container at the exit bend from the first portion. Such platelets as have already been separated will then move at high velocity through the transition portion and into the second smaller spiral-like portion of the container. It has been found that high flow velocity of the concentrate is very necessary if the platelets are not to aggregate into clumps, which would then require a resuspension operation. For this reason, the inner width of the container for the second portion is reduced to substantially one quarter the inner width of the first portion, for example, one sixteenth inch and one quarter inch respectively. Reduction in the cross section results in higher flow velocity in the narrower portion.

At the terminal or outlet end of the second or spiral-like portion of the container, there is provided a collecting chamber 23 in the cavity 16. This is a closed chamber in the cavity, with the exit end of container 13 entering at one side thereof, slightly above the outward wall or bottom of the cup. A small bore tube extends from the inward or top end of the well down to, but not touching the bottom. This tube 20 is the platelet concentrate outlet connection. As noted previously, it is necessary to keep the cross-sectional area relatively small in order to achieve high flow rates. Thus the platelet concentrate connection 20 is on the order of one thirty-second of an inch I. D. as compared with the three-sixteenths inch I. D. for the other connections. A plasma outlet connection 19 is provided at the top of the collecting well or chamber 23.

Figure 3:
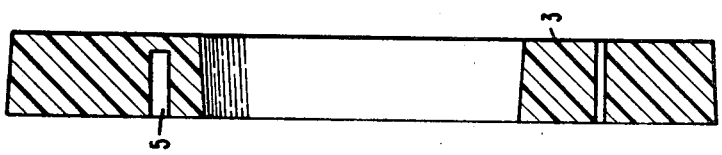
FIG. 3 is a sectional elevational view of the filler piece of FIG. 2 taken at the section 3—3.

FIG. 3 is a cross-sectional elevation view taken along the section line 3—3 in FIG. 2, and shows the vertical alignment of the two portions.

It will be readily apparent to those skilled in the art that the embodiment described above provides an assembly in which a plurality of filler pieces could be interchangeably utilized in the same centrifuge bowl, including the one described above. If such interchangeability is undesirable or unnecessary, a one-piece rotor may be used, forming, with the container, another preferred embodiment of the invention.

Figure 4:
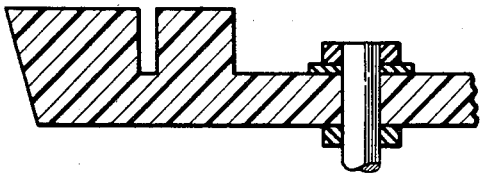
FIG. 4 is a diagrammatic partial cross section elevation view of a centrifuge assembly using a one-piece rotor, in accordance with another preferred embodiment of the invention.

Such a structure will be apparent from the cross-sectional view shown in FIG. 4, showing how the bowl and center piece can be formed from one piece of material, either by molding or machining.

Figure 5A:
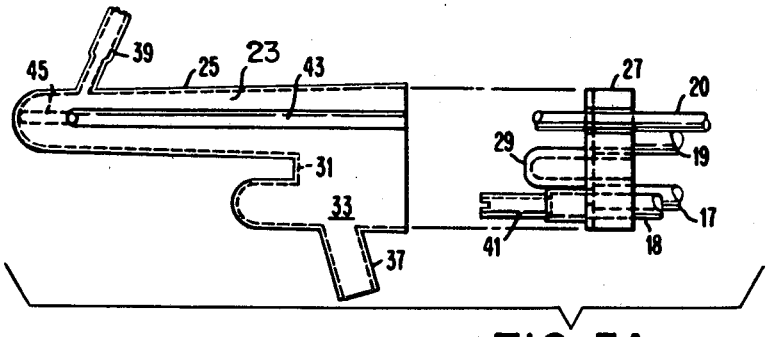
FIG. 5A is an exploded plan view of the cavity and its top, in which the ends of the container are cemented and wherein the various input and output lines are terminated.
Figure 5B:
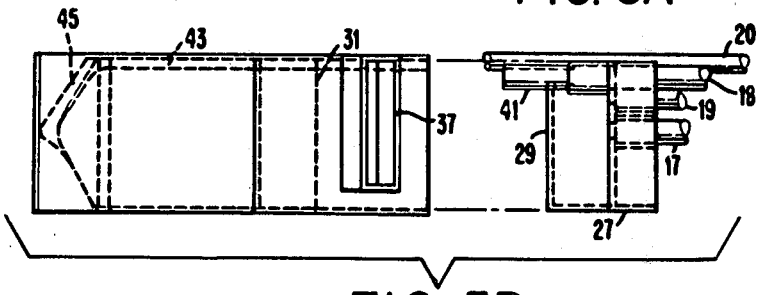
FIG. 5B is an exploded elevational view of the cavity.

Referring to FIGS. 5A and 5B, the cavity 16 comprises a bottom portion 25 and a top or plug 27, each preferably molded from suitable plastic, and then cemented together. The boss or projection 29 on the top 27 contacts the portion 31 of bottom 25 and is cemented thereto to effectively divide the cavity into two chambers, an inlet chamber generally designated by reference character 33 and an outlet chamber 23. The side opening 37 receives the inlet end of the first spiral portion of the fluid container, and the side opening 39 receives the outlet end of the second spiral portion of the container. The whole blood input line 17 is received in the portion of cap 27 at the top of the inlet chamber 33. The red blood cell line 18 has an extension 41 which extends to the bottom of inlet chamber 33, where the red blood cells collect after retroflow in the first spiral portion of the container. Plasma outlet line 19 is terminated in the top of cap 27, on the side comprising the outlet chamber 23. The platelet output line 20 is received in a groove 43 extending along the cavity and having its outer end cemented in a passage which opens into the outermost end of the outlet chamber 23.

Figure 6:
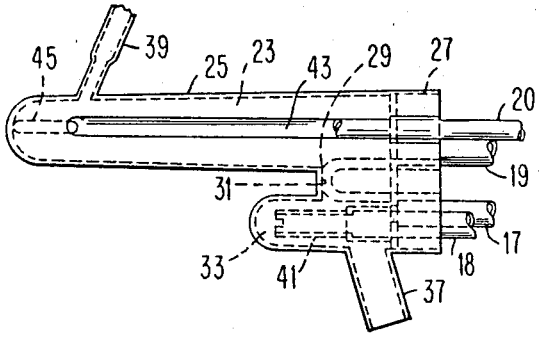
FIG. 6 is a view showing the assembled parts of FIG. 5A.

FIG. 6 shows the relationship of the assembled top and bottom portion shown in FIG. 5A.

From the foregoing, it will be apparent that the present invention provides a novel centrifuge assembly which is advantageous from the standpoint of being economical to fabricate and includes a low cost simple disposable fluid container to be discarded after a single use, thereby removing the expensive duties of cleaning and sterilizing required with reusable centrifuge containers.

While the invention has been particularly shown and described with reference to several preferred embodiments thereof, it will be understood by those skilled in the art that various changes in form and details may be made therein without departing from the spirit and scope of the invention.

I claim:

1. A disposable elongated container of semirigid material for use in a centrifuge, said container having first and second ends, a first portion of said container being adapted to have a circular-like configuration and a second portion of said container being adapted to have a spiral-like configuration with an increasing radius, a transisition portion connecting the terminal end of the first portion with the initial end of the second portion, said initial end of the second portion being adapted to be located radially inward of the terminal end of the first portion, a plurality of fluid connections to the first end of said elongated container for introducing fluid near the inner wall and for withdrawing the component of said fluid which accumulates beyond the inlet, at least one fluid connection to the second end of said elongated container for withdrawing the remaining fluid, whereby some of the fluid that enters at the first end of said container counterflows back to said first end and exits at said first end while the remaining fluid exits at said second end.

2. A container as claimed in claim 1, in which said fluid connections comprise an inlet connection to one end of said container, and at least one output connection to the other end of said container.

3. A disposable elongated container as claimed in claim 1, characterized by said container comprising a length of semirigid tubing having a substantially rectangular cross section.

4. A container as claimed in claim 3, in which the height and width of the container correspond to the height and width of said channel.

5. A disposable container as claimed in claim 1, in which said container is provided with a collecting well at the outlet end thereof, and outlet fluid connections at the outlet end of the container are terminated in said collecting well.

6. A centrifuge assembly for use in a centrifuge having a rotor bowl, comprising, in combination, means forming a channel which has first and second portions connected seriatim, said first portion having a circular configuration and said second portion having a spiral-like configuration, a disposable elongated container of semirigid material contained in said channel, said container having first and second portions corresponding to the first and second portions of said channel, each of said first and second portions having first and second ends, a transisition portion connecting the second end of the first portion with the first end of the second portion, said first end of the second portion being located radially inward of the second end of the first portion, and a plurality of fluid connections to the first end of said elongated container for introducing fluid near the inner wall and for withdrawing the component of said fluid which accumulates beyond the inlet, at least one fluid connection to the second end of said elongated container for withdrawing the remaining fluid, whereby some of the fluid that enters at the first end of said container counterflows back to said first end and exits at said first end while the remaining fluid exits at said second end.

7. A container as claimed in claim 6, in which said container is formed from medical grade polyvinyl chloride.

8. A centrifuge assembly as claimed in claim 6, in which said means for forming a channel comprises a filler piece is provided with a plurality of radial slots to receive said fluid connections.

9. A centrifuge assembly as claimed in claim 6, wherein the width of the disposable container in said second spiral-like portion is substantially one-fourth of the width of the container in said first spiral portion.

10. A centrifuge assembly as claimed in claim 6 in which said first portion of said channel and said container has a constant radius offset from the true center to permit red blood cells to flow along the outer wall of said container in the direction opposite to the flow of incoming whole blood.

* * * * *